US006489723B2

(12) United States Patent
Miyanaga

(10) Patent No.: US 6,489,723 B2
(45) Date of Patent: Dec. 3, 2002

(54) ULTRA-HIGH PRESSURE MERCURY LAMP

(75) Inventor: Shoji Miyanaga, Takasago (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 64 days.

(21) Appl. No.: 09/839,230

(22) Filed: Apr. 23, 2001

(65) Prior Publication Data

US 2001/0052754 A1 Dec. 20, 2001

(30) Foreign Application Priority Data

May 8, 2000 (JP) ..... 2000-139406

(51) Int. Cl.[7] ..... H01J 61/00

(52) U.S. Cl. ..... 313/632; 313/633; 313/630; 313/491

(58) Field of Search ..... 313/633, 630, 313/631, 632, 491

(56) References Cited

U.S. PATENT DOCUMENTS

| | | | | |
|---|---|---|---|---|
| 4,906,895 A | * | 3/1990 | Pabst et al. | 313/633 |
| 5,109,181 A | | 4/1992 | Fischer et al. | |
| 5,497,049 A | | 3/1996 | Fischer | |
| 5,530,317 A | * | 6/1996 | Willemsen et al. | 313/633 |

* cited by examiner

*Primary Examiner*—Ashok Patel
(74) *Attorney, Agent, or Firm*—Nixon Peabody LLP; David S. Safran

(57) ABSTRACT

A direct-current-lighting, ultra-high-pressure mercury lamp that is resistant to loss of transparency even after being lit for a long period, and has little wastage of electrodes and particularly the cathode tip, and also exhibits a long service life. The direct-current ultra-high-pressure mercury lamp includes a cathode and anode of tungsten facing each other within a quartz glass tube, and a cathode coil which is wrapped around the cathode. The cathode is composed of tungsten doped with potassium, and the anode is composed of tungsten having a purity of at least 99.99%. The cathode coil can also be advantageously formed of tungsten having a purity of at least 99.99%.

5 Claims, 2 Drawing Sheets

ULTRA-HIGH PRESSURE MERCURY LAMP

BACKGROUND OF THE INVENTION

1. Field of the Invention

The present invention is directed to a direct-current ultra-high-pressure mercury lamp used as a light source for liquid crystal projector equipment and DLP projector equipment.

2. Description of the Related Art

Light source equipment with a short-arc discharge lamp within a convex reflector mirror made of borosilicate glass is conventionally used for liquid crystal projector equipment and DLP projector equipment. However, because projector equipment is required to project an image evenly and with adequate chromaticity, metal halide lamps that incorporate mercury and metal halides and that have good chromaticity have been used as light source lamps. Smaller and lighter equipment is also highly desirable, and thus, discharge lamps must be made smaller.

Recently, there has been movement toward smaller lamps as point light sources, and there has also been an increase demand for discharge lamps with very short interelectrode distances. However, in metal halide lamps that incorporate a metal with a lower energy of excitation than mercury, if the interelectrode distance is less than a certain amount, there are limits to how much the brightest spot can be concentrated. Accordingly, it becomes difficult to make a smaller point light source. For that reason, short-arc ultra-high-pressure mercury lamps having a very high mercury vapor pressure when lit, for example 20 MPa or higher, have come into use in place of metal halide lamps. In order to have such a high mercury vapor pressure value when lit, at least 0.15 $mg/mm^3$ of mercury is incorporated within the tube. In such an ultra-high-pressure mercury lamp, arc spread is controlled, and it is possible to enhance further the light output and improve chromaticity. Such ultra-high-pressure mercury lamps have been presented in U.S. Pat. No. 5,109,181 and U.S. Pat. No. 5,497,049.

In view of the aforementioned related art problems, there is a requirement for lamps with greater light output, superior chromaticity, and also longer service life. Specifically, it is desirable that, while the lamp is used in projector equipment, the radiant intensity of light from an ultra-high-pressure mercury lamp does not drop or change, but be maintained as stable as possible. As stated above, however, small size is required for a ultra-high-pressure mercury lamp used as a light source for projector equipment, thus, small tubes with volumes not exceeding 300 $mm^3$ are used. Consequently, the load on the tube wall is great, and the temperature within the tube reaches 950° C. to 1050° C. For that reason, over long hours of use, the quartz glass that is the material of the tube gradually opacities and loses transparency, and because the transparency to light declines, the radiant intensity of the light drops. Moreover, the temperature of the electrode tip reaches 2500° K or above; because the temperature is very high, impurities included in the tip of the electrode, which is made of tungsten, evaporate and wastage occurs. Then the vaporized materials adhere to the inner wall of the tube, and darken the tube. This reduces the transparency to light and causes deterioration of the light output, and also reduces the transparency of the quartz glass. In particular, the cathode is smaller than the anode and has a smaller heat capacity, and its sharply pointed tip is liable to wastage.

SUMMARY OF THE INVENTION

Accordingly, it is an object of the invention to provide a direct-current ultra-high-pressure mercury lamp which has a tube that does not lose transparency even during long hours of use, exhibits low waste of the electrodes and particularly the tip of the cathode, and a longer service life than conventional lamps.

These and other objects are achieved by a direct-current, ultra-high-pressure mercury lamp in which a cathode and an anode of tungsten face each other within a quartz glass tube. The cathode is preferably composed of tungsten doped with potassium and includes a cathode coil wrapped around the cathode rod and which is composed of tungsten having a purity of at least 99.99%. The anode is preferably composed of tungsten having a purity of at least 99.99%.

In conventional ultra-high-pressure mercury lamps, the electrodes have been formed of tungsten with a purity of at least 99.9%. Tungsten with a purity of at least 99.9% has metallic impurities including about 60 wt-ppm (hereafter "ppm") of K, as well as many others such as Fe, Al, Si, Mo, Ni, Mg, Cu, Mn and Na, for a total of 100 ppm to 1,000 ppm. The lamp is very hot when lit and, as stated previously, these metallic impurities vaporize and adhere to the inner wall of the tube. Not only does the tube darken because of them, but the inventors discovered that when the temperature is raised to 1000° C., quartz glass crystallizes with these adhered impurities as nuclei, hastening the loss of transparency. Accordingly, in accordance with the present invention the anode is formed of tungsten with a purity of at least 99.99% including about 5 ppm of potassium and preferably at least 99.999% including about 0.1 ppm of potassium. As a result, the metallic impurities that vaporize from the tip of the anode and adhere to the inner wall of the tube are very scant, and even after long hours of being lit at high temperatures, there is almost no darkening or loss of transparency in the tube, and deterioration of the light output is suppressed.

There is less vaporization of metallic impurities if the cathode is also formed of high-purity tungsten. However, if the purity of the cathode is high and there are very few impurities, the work function of the tip of the cathode is increased, causing an increase of temperature of the cathode tip, which has a small heat capacity, and wastage actually increases. Therefore, in accordance with the present invention, the cathode is composed of tungsten doped with preferably potassium. However, potassium is an alkali metal, and thus, vaporizes yielding positive ions with a valance of 1. The positive ions are attracted to the cathode, which is electrically negative, and create a layer on the surface of the cathode. In other words, when the lamp is lighted stably a certain amount of the potassium with which the cathode is doped vaporizes but does not disperse to the inner surface of the tube; in effect it functions as an emitter. Accordingly, it is possible to suppress wastage of the cathode tip by doping with potassium so the purity of the cathode is not too high.

In addition, the temperature of the cathode coil that is composed of tungsten and wrapped around the cathode from which the arc begins to jump when the lamp is ignited rises quickly. Although the mass of the cathode coil is small, dispersion of the metallic impurities included in the cathode coil would have a deleterious effect. Therefore, it is desirable that the cathode coil, like the anode, be made of tungsten with a purity of at least 99.99%.

DETAILED DESCRIPTION OF THE PREFERRED EMBODIMENT

Figure 1:
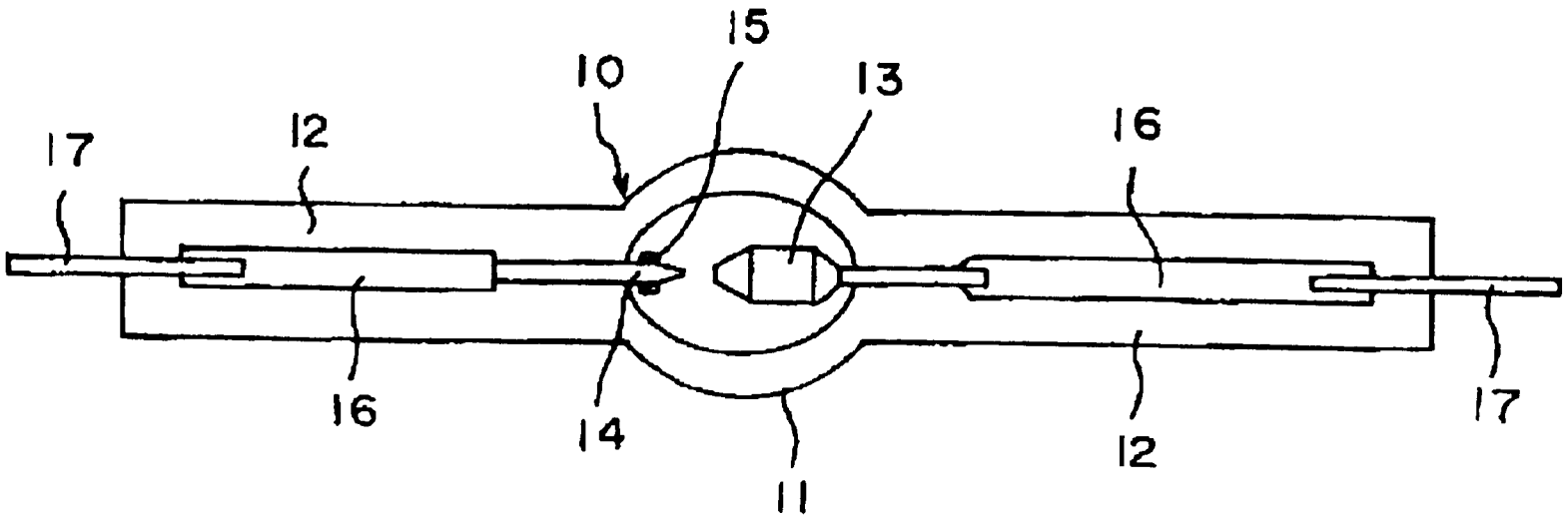
FIG. 1 shows a side view of a direct-current lighting type ultra-high-pressure mercury lamp in accordance with the present invention.

FIG. 1 shows a direct-current lighting type ultra-high-pressure mercury lamp 10 including an elliptical-shaped tube 11 composed preferably of quartz glass and having an interior volume of 300 $mm^3$ or less defining a discharge space. Mercury and a rare gas are hermetically sealed within the discharge space, the mercury having a predetermined amount of at least 0.15 $mg/mm^3$. First and second electrode assemblies including an anode 13 and a cathode 14 face each other within the tube 1 and a cathode coil 15 is wrapped around the cathode 14. The anode 13 is composed preferably of tungsten having a purity of at least 99.9%; the cathode 14 is composed preferably of tungsten doped with potassium, the purity of the tungsten being preferably at least 99.99%. It is desirable, however, that there be as few impurities as possible other than the potassium. The concentration of the potassium used for doping is 60 ppm. Additionally, the purity of the tungsten of the cathode coil 15 can be at least 99.9%, but 99.99% is preferable.

The tube 11 includes elongated seal portions 12 that extend on both sides of the tube 11 outwardly along the tube axis and are formed by attaching molten quartz glass pipes extending from both sides of the tube 11, and then reducing the interior pressure. A metallic foil 16 of molybdenum is sealed air-tight within the seal portions 12 to electrically connect the anode 13 and the cathode 14 to their respective external leads 17. As for the specific values of the ultra-high-pressure mercury lamp 10, the internal volume of the tube 11 is preferably 116 $mm^3$, and the internal surface area is preferably 120 $mm^2$. The amount of mercury incorporated is 15 mg, and argon is incorporated as a rare gas at a pressure of 11.3 kPa. The interelectrode distance is 1.5 mm, the lamp voltage is 75V, the lamp current is 2 A, the rated power consumption is 150 W, and the load on the tube wall is 1.6 $A/cm^2$.

Figure 2:
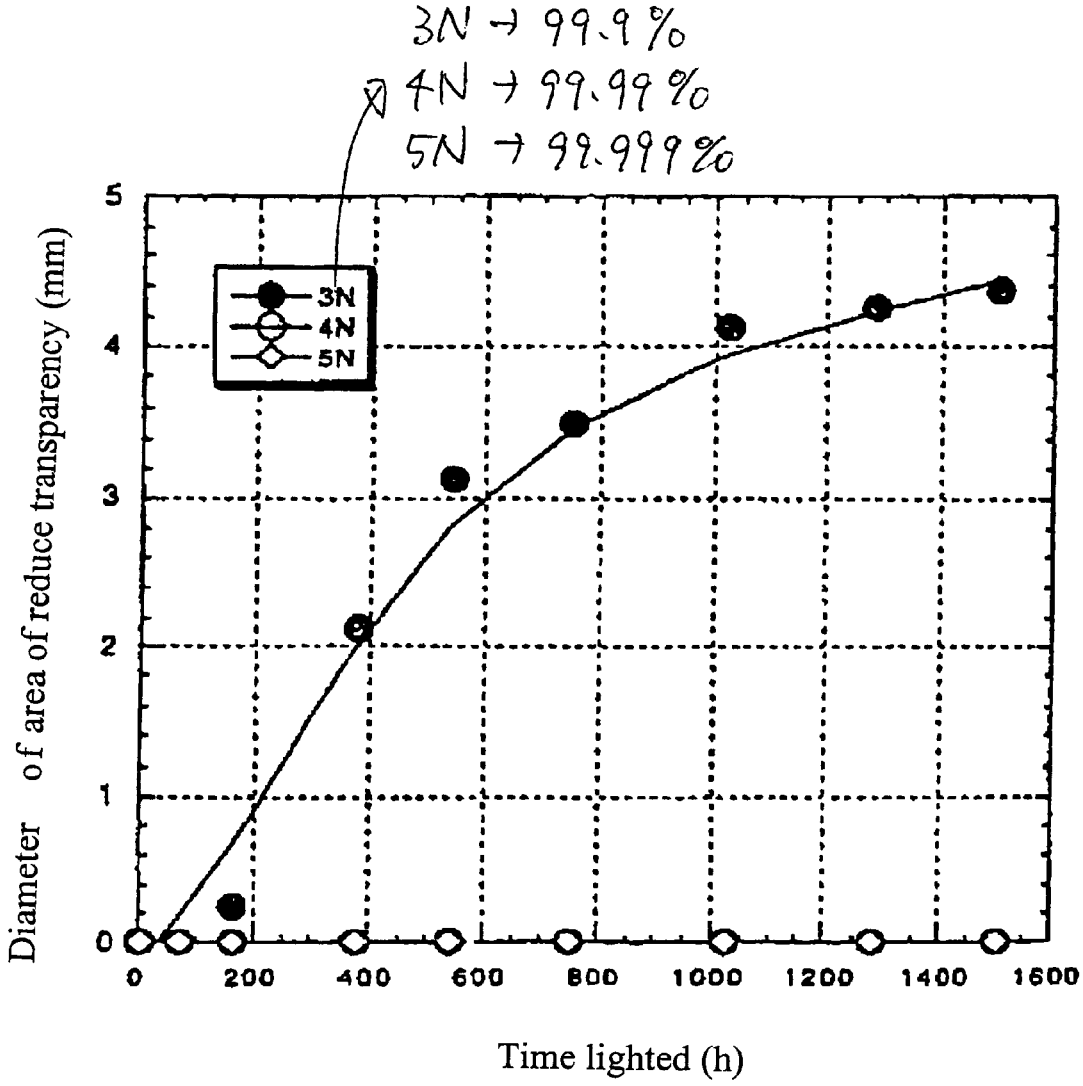
FIG. 2 shows a graph contained the results of the relationship between the period of use (length of time of the tube being lit) and the degree of loss of transparency in the tube.

Experimental data was obtained using an ultra-high-pressure mercury lamp of the previous description with an anode having variations in the purity of the tungsten, a cathode composed of tungsten doped with a concentration of potassium, and wherein the lamps were lit for 1,500 hours, and then checked for loss of transparency of the tube and wastage of the tip of the cathode. The results are shown in table 1. In the example of the related art, the anode, cathode and cathode coil were all of tungsten of 99.9% purity, and the concentration of potassium included in the tungsten of the cathode was 60 ppm. In control cases 1 and 2, the purity of the tungsten in the anode, cathode and cathode coil were 99.99% and 99.999%, and the concentration of potassium included in the tungsten of the cathode was low. In table 1, the loss of transparency is shown as diameter in mm of the region of transparency loss on the inner surface of the luminescent portion. The wastage of the cathode was judged by projecting an enlarged view of the cathode tip and making a visual inspection of the degree of loss, which was expressed as great or small. The unit for the concentration of potassium in the anode was ppm. Then, the relationship between the length of time lighted and the degree of loss of transparency was investigated, taking the purity of the anode as a parameter; the results are shown in FIG. 2.

TABLE 1

| | Anode purity | Coil purity | Concentration of K in cathode | Loss of transparency | Wastage |
|---|---|---|---|---|---|
| Prior technology | 3N | 3N | 60 | 4 | Small |
| Control 1 | 4N | 4N | 5 | 0 | Great |
| Control 2 | 5N | 5N | 0.1 | 0 | Great |
| Test 1 | 4N | 3N | 60 | 0.1 | Small |
| Test 2 | 5N | 3N | 60 | 0.1 | Small |
| Test 3 | 4N | 4N | 60 | 0 | Small |
| Test 4 | 5N | 5N | 60 | 0 | Small |

(3N = 99.9%, 4N = 99.99%, 5N = 99.999%).

As can be seen from table 1, in the example of the related art, there is little wastage of the cathode, but great loss of transparency of the tube. Moreover, as shown in FIG. 2, the loss of transparency of the tube increases with the hours lit in the case of the anode made of tungsten with a purity of 99.9%. In control cases 1 and 2, where the tungsten of the cathode was not doped with potassium and the concentration of potassium was low, there was no loss of transparency of the tube after lighting for 1,500 hours, but the wastage of the cathode was great. Consequently, in all three cases, there is either the disadvantage of deterioration of light output because of loss of transparency or darkening of the tube, or that of short service life.

In contrast, in the test cases 1 and 2, where the purity of the cathode coil was 99.9%, there was little wastage of the cathode, and very little darkening of the tube; loss of transparency to that extent would be no problem in practical use. In the test cases 3 and 4, where the purity of the cathode coil was 99.99% or better, there was little wastage of the cathode, and after 1,500 hours of use, the tube had no loss of transparency and thus little deterioration of light output. This means a long service life, and quite a favorable result. FIG. 2 shows that there was no loss of transparency of the tube even after being lit for 1,500 hours in test case 3, where the purity of the tungsten of the anode was 99.99%, or test case 4, where it was 99.999%.

As explained above, the direct-current lighting type ultra-high-pressure mercury lamp of this invention uses tungsten doped with potassium for the cathode and the purity of the tungsten of the anode is 99.99% or better, and so even after it has been lit for long hours, the tube is unlikely to lose transparency, there is little wastage of the electrodes, particularly the cathode tip, and the lamp has a long service life. Moreover, when the purity of the tungsten of the cathode coil, which wraps around the cathode, is 99.99% or better, there is even less darkening of the tube, so this is preferred.

What is claimed is:

1. A direct-current lighting ultra-high-pressure mercury lamp comprising:

a quartz glass tube that defines a discharge space; and first and second electrode assemblies including a cathode and an anode positioned in said tube so as to face each other inside said discharge space, said anode being composed of tungsten having a purity of at least 99.99% and said cathode being composed of tungsten doped with potassium.

2. The ultra-high-pressure mercury lamp as described in claim 1, further comprising a coil mounted so as to wrap around said cathode, said coil being composed of tungsten having a purity of at least 99.99%.

3. The ultra-high-pressure mercury lamp as described in claim 1, wherein said discharge space has a volume not exceeding 300 $mm^3$.

4. The ultra-high-pressure mercury lamp as described in claim 3, wherein at least 0.15 $mg/mm^3$ mercury is incorporated within the tube.

5. The ultra-high-pressure mercury lamp as described in claim 1, wherein at least 0.15 $mg/mm^3$ mercury is incorporated within the tube.

* * * * *